United States Patent [19]

Wren, Jr. et al.

[11] 4,190,971

[45] Mar. 4, 1980

[54] KARATE FOOT PROTECTOR

[75] Inventors: Fred H. Wren, Jr.; Frank H. Babcock, III, both of St. Louis, Mo.

[73] Assignee: Pro-tect, Inc., St. Louis, Mo.

[21] Appl. No.: 925,807

[22] Filed: Jul. 18, 1978

[51] Int. Cl.[2] ..... A43B 5/00; A41D 17/00

[52] U.S. Cl. ..... 36/106; 36/2 R; 36/114

[58] Field of Search ..... 36/2 R, 114, 106, 105; D2/309; 2/22

[56] References Cited

U.S. PATENT DOCUMENTS

| | | | |
|---|---|---|---|
| 3,193,950 | 7/1965 | Liou | 36/50 |
| 3,769,722 | 11/1973 | Rhee | D2/309 |
| 4,008,531 | 2/1977 | Schonbrun et al. | 36/106 |
| 4,103,437 | 8/1978 | Dillard | 36/106 |

*Primary Examiner*—Patrick D. Lawson
*Attorney, Agent, or Firm*—Cohn, Powell & Hind

[57] ABSTRACT

This foot protector includes a front portion providing a protective cover for the toes and instep of the wearer and a wrap-around rear portion protecting the back and ankle portions of the foot, the protector being fully open at the bottom. The rear portion of the protector includes oppositely disposed sides extending above the front portion and the rear portion is formed into separable portions which are provided with lace openings. The upper side portions are also provided with lace openings so that the separated side portions can be laced together by a single lace which extends around the ankle to draw the sides together and secure the protector to the foot. Reinforcing strips are provided to strengthen the lace margins and the junction between the front and rear portions of the shoe.

8 Claims, 6 Drawing Figures

KARATE FOOT PROTECTOR

BACKGROUND OF THE INVENTION

This invention relates generally to a foot protector for karate combat, and other martial art sports and particularly to a protector having lace ties.

The art of karate combat requires frequent use of the feet and hands and in order to avoid damage to these members protective clothing in the form of padded shoes and gloves are frequently used. It is necessary that such protective shoes be constructed so that they can be readily put on and taken off without damage to the shoe and without sacrificing the comfort of the wearer. This has caused considerable problems in the past.

Protective shoes are known, for example, the shoes disclosed in U.S. Pat. No. 3,769,722 which provide a protective cover that must be stretched in order to position it on the foot for the reason that the upper opening into which the foot is inserted must be small enough to enclose the ankle and hold the shoe comfortably in place. Another known shoe provides multiple nylon pile fasteners which permit enlargement of the foot receiving opening but require careful emplacement for satisfactory usage.

The above disadvantages have been overcome with present foot protector in a manner not disclosed in the known cited art.

SUMMARY OF THE INVENTION

This foot protector for karate combat can be easily removed and replaced without damage to the protector and without sacrifice of comfort to the wearer.

The foot protector includes a unitary body formed from a resilient foam core material and having a flexible outer casing, the body providing a front portion adapted to cover the upper foot and a wrap-around rear portion adapted to cover the back and ankle portions of the foot. The rear portion consists of opposed side portions one of which is separated into parts attachable together by a continuous lace which also serves to secure the protector to the foot.

The rear portion of the protector includes opposed side portions extending upwardly above the front portion, said side portions being defined by upper margins and forwardly disposed, downwardly depending front margins extending into said front portion to define an enlarged foot opening.

The side portions include a plurality of lace receiving openings by which the lace connects the separated side portions together and which acts as a drawstring to urge the upper side portions of the protector together.

The inner side portion is formed into fore and aft abutting parts held together by a continuous lace and reinforced in the area of the lace openings by a nylon strip molded into the foot protector.

The front margins of the rear portion join together at the junction of the front and rear portions and are defined by a bight portion which is reinforced by a nylon reinforcing strip molded into the foot protector.

This foot protector is relatively simple and inexpensive to manufacture and can be effectively and comfortably used by practitioners of the karate martial arts.

DESCRIPTION OF THE PREFERRED EMBODIMENT

Figure 2:
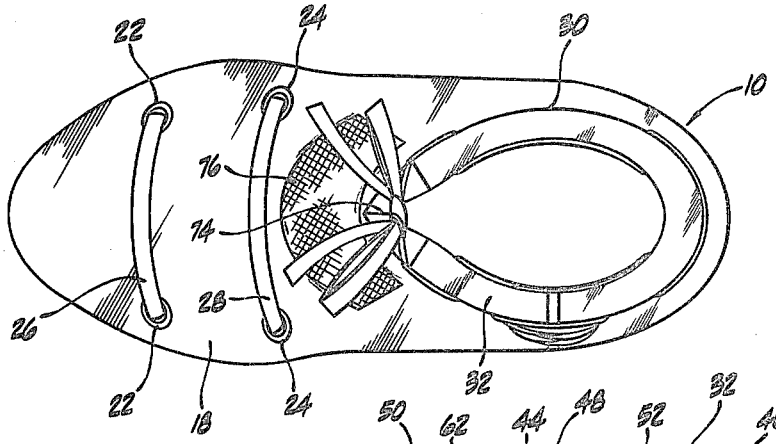
FIG. 2 is a plan view thereof.
Figure 1:
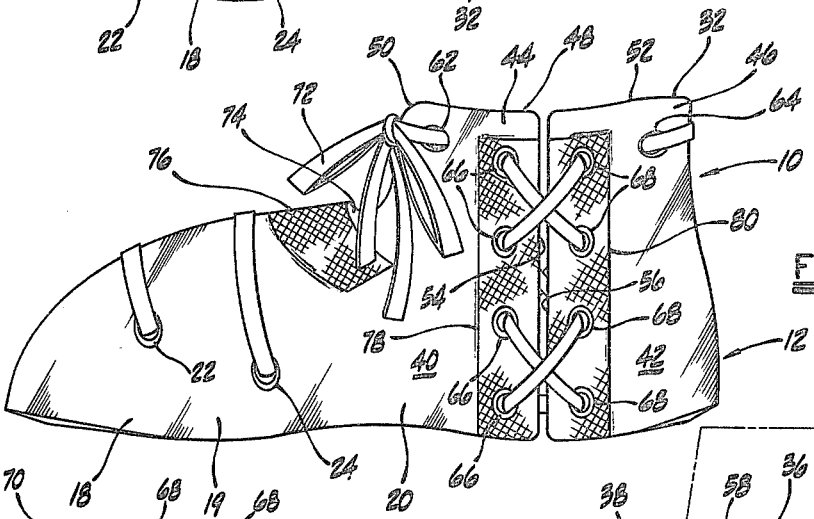
FIG. 1 is a side elevational view of the foot protector illustrating the side lacing arrangement.
Figure 3:
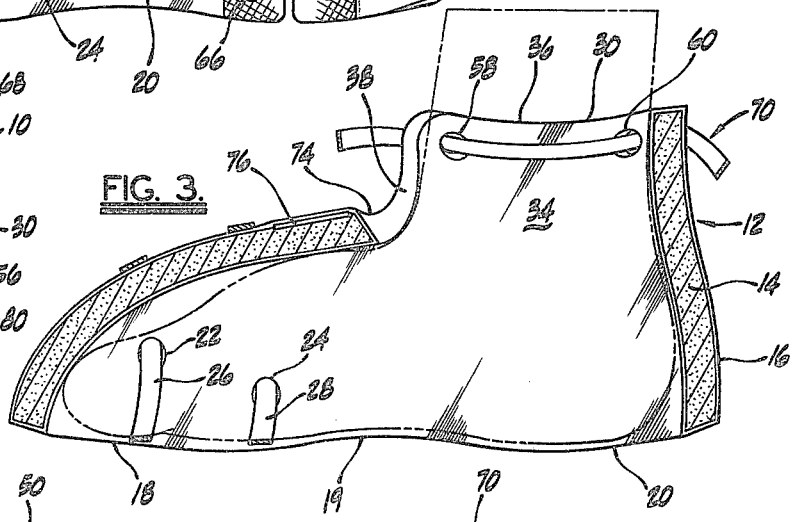
FIG. 3 is a longitudinal sectional view thereof.

Referring now by reference numerals to the drawings and first to FIGS. 1 and 3, it will be understood that the foot protector, generally indicated by numeral 10 comprises essentially of a unitary body 12 having an inner core 14 or resilient material such as rubber foam or the like, and a flexible outer casing 16 formed by dipping the core into liquid polyvinyl chloride or the like. The protector 10 shown in the drawing is for the right foot. The body 12, which is open at the bottom, includes a front portion 18 covering the instep or upper portion of the foot F, the toes and the front sides of said foot. The body 12 also includes a wrap-around rear portion 20 which is integrally formed with the front portion 18 and is adapted to cover the back and ankle portions of the foot F. The bottom of the body 12, defined by a circumferential lower margin 19, is open.

The body front portion 18 is provided with opposed pairs of front and rear spaced openings 22 and 24 respectively which receive associated substantially continuous elastic bands 26 and 28 which, in the preferred embodiment encircle the forward portion of the foot F.

The body rear portion 20 includes outer and inner side portions 30 and 32 constituting first and second portions respectively. Both side portions 30 and 32 extend rearwardly from the front portion 18, with which they are unitarily formed, to join at the extreme rear end of the body 12. The outer side portion 30, as shown in FIG. 3, includes an upper portion 34 disposed generally above the front portion 18 and defined by an upper margin 36 and a downwardly depending front margin 38. The inner side portion 32, as shown in FIG. 1, is formed from two separable parts 40 and 42 each of which includes an upper portion 44 and 46 respectively. The upper portion 44 is defined by an upper margin 48 and a downwardly depending front margin 50 while the upper portion 46 is defined by an upper margin 52. Both of the separated parts 40 and 42 are defined by substantially vertical margins 54 and 56 respectively which, in the preferred embodiment, are disposed in abutting relation.

As shown clearly in FIG. 3 the upper portion 34 of the outer side portion 30 includes spaced front and rear lace openings 58 and 60. In a like manner, and as shown in FIG. 1 the separable parts 40 and 42 of the inner side portion 32 each includes spaced lace openings 62 and 64 respectively. In addition, the separable parts 40 and 42 each includes plurality of lace openings 66 and 68 respectively and four in number in the preferred embodiment, disposed adjacent vertical margins 54 and 56 respectively.

Figure 4:
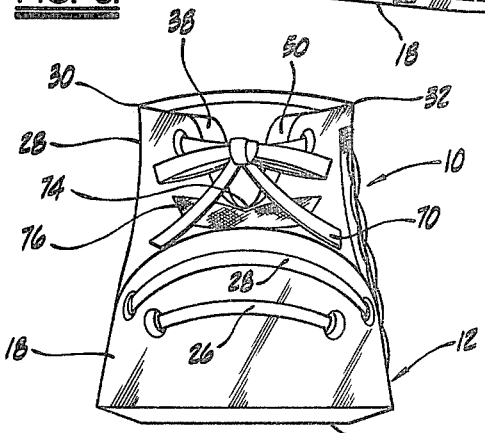
FIG. 4 is a front end elevational view thereof.
Figure 5:
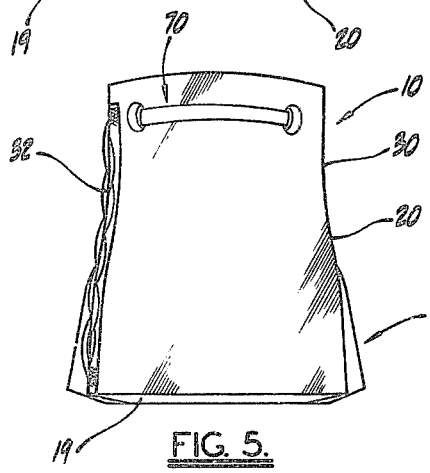
FIG. 5 is a rear end elevational view thereof.

As clearly shown by FIGS. 1 and 3, the foot protector 10 includes a continuous lace 70 which is received in laced relation through all of the vertical lace openings 66 and 68, and the upper side lace openings 58, 60 and 62, 64, said openings constituting lace retaining means. When laced in the manner shown, the lace 70 acts as a drawstring to secure the protector 10 about the foot and can be tied at the front, as by a bow 72 in the conventional manner. As shown particularly in FIG. 4 the upper portion free margins 38 and 50 come together at their lower end to form a bight portion 74 which extends forwardly into the protector front portion 18 to define an enlarged portion of the opening receiving the foot F. In the preferred embodiment, a strip of nylon reinforcing material, generally indicated by numeral 76, is secured as by adhesion to the resilient foam core 14 prior to coating said core with the flexible outer casing 16. In like manner, the area containing the lace openings 66 and 68 adjacent margins 54 and 56 respectively, is reinforced by nylon strips 78 and 80 respectively, disposed between the resilient foam core 14 and the flexible outer casing 16.

It will be understood that the provision of upper side portions 32 and 44, which are defined by spaced front margins 38 and 50, and which are therefore not connected at their front end provides, in effect, flaps which can be turned back to permit the insertion of the foot into the increased opening size provided by the bight portion 74. Thus, when the lace 70 is untied the foot F can be readily inserted into the relatively large opening provided and when the lace is tied the "opening" is decreased by the drawstring action of the lace 70 which effectively provides an opening of a size defined by the combined upper margins 36, 48, and 52. Further, the provision of the separable parts 40 and 42 of the inner side portion 32 allows the vertical margins 54 and 56 to be spread at their upper end to permit the foot opening to be increased even more. The forwardly disposed bight portion 74, at the termination of the front margins 38 and 50, is strengthened considerably by the provision of the nylon reinforcing strip 76 and the area in the vicinity of the side margins 54 and 56 is similarly strengthened by the provision of nylon reinforcing strips 78 and 80.

Figure 6:
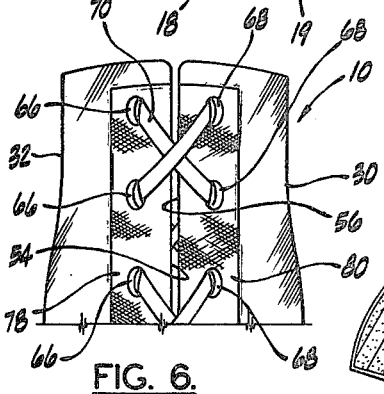
FIG. 6 is a fragmentary end elevational view of a modified shoe.

It will be understood that although the lace in the embodiment shown is disposed intermediate the inner side portion of the foot protector, it could be moved to the rear as shown in FIG. 6 in which, for convenience, like parts are given the same reference numeral. The arrangement shown in FIG. 6 differs slightly from that shown in FIG. 1 in that the upper rear lace openings 64, shown in FIG. 1, can be omitted and are in effect replaced by the upper two lace openings 66 and 68 as shown in FIG. 6. Upper front lace openings 62 are retained and receive the lace 70 in the same manner as for the embodiment shown in FIG. 1.

We claim as our invention:

1. A foot protector for karate combat comprising:

(a) a unitary body formed from a resilient foam core having a flexible outer casing, the body including, (1) a front portion adapted to cover the upper portion of the foot and the front sides thereof, (2) a wrap-around rear portion adapted to cover the ankle portion of the foot and including a first side portion extending rearwardly from said front portion and having an upper portion defining an upper margin and a downwardly depending front margin, and a second side portion extending rearwardly from said front portion to join said first side portion and having an upper portion defining an upper margin and a downwardly depending front margin spaced from the front margin of said first side portion, (3) an open bottom portion defined by a lower margin, (4) said second side portion being formed into two at least partially separable parts to define adjacent substantially vertical margins disposed in side-by-side relation, and (5) said first side upper portion including spaced front and rear lace openings and said second side upper portion including spaced front and rear lace openings and a plurality of lace openings adjacent each vertical margin, and (b) a lace received by said lace openings to connect the separable parts together and to substantially encircle the ankle and tie together adjacent front margins tending to pull said margins toward each other.

2. A foot protector as defined in claim 1, in which:

(c) said front margins are joined at their lower end to define a bight portion extending into said upper portion.

3. A foot protector as defined in claim 2, in which:

(d) a reinforcing strip is molded between said flexible casing and the foam core in the vicinity of the bight portion.

4. A foot protector as defined in claim 1, in which:

(c) the separable parts are defined by vertical margins extending between the upper and lower margins and disposed in abuttable relation.

5. A foot protector as defined in claim 1, in which:

(c) a reinforcing strip is molded between said foam core and said flexible casing adjacent to each vertical margin.

6. A foot protector for karate combat comprising:

(a) a unitary body formed from a resilient foam core having a flexible outer casing, the body including:

1. a front portion adapted to cover the upper portion of the foot and the front sides thereof, 2. a rear portion adapted to cover the ankle portion of the foot and including a first side portion extending rearwardly from said front portion and having an upper portion defining an upper margin and a downwardly depending front margin, and a second side portion extending rearwardly from said front portion to join said first side portion and having an upper portion defining an upper margin and a downwardly depending front margin spaced from the front margin of said first side portion said front margin being joined at their lower end to define a bight portion, 3. an open bottom portion defined by a lower margin, 4. said rear portion being formed into two at least partially separable parts to define adjacent substantially vertical margins disposed in side-by-side relation and having a plurality of lace retaining means disposed adjacent thereto, and 5. said side portions including at least one forwardly disposed lace retaining means disposed adjacent each upper margin, and (b) a lace received by said lace retaining means to connect the separable parts together and to substantially encircle the ankle and tie together adjacent front margins tending to pull said margins toward each other.

7. A foot protector as defined in claim 6, in which:

(c) said lace retaining means are provided by lace openings.

8. A foot protector as defined in claim 6, in which:

(c) said rear portion first and second opposed side portions extend rearwardly from said front portion a substantially equal amount to provide said separable parts.

* * * * *